US007635957B2

(12) United States Patent
Tripathi et al.

(10) Patent No.: US 7,635,957 B2
(45) Date of Patent: Dec. 22, 2009

(54) LED TEMPERATURE-DEPENDENT POWER SUPPLY SYSTEM AND METHOD

(75) Inventors: Ajay Tripathi, Schaumburg, IL (US); Bernd Clauberg, Schaumburg, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 683 days.

(21) Appl. No.: 10/570,539

(22) PCT Filed: Sep. 1, 2004

(86) PCT No.: PCT/IB2004/051654

§ 371 (c)(1),
(2), (4) Date: Mar. 3, 2006

(87) PCT Pub. No.: WO2005/025274

PCT Pub. Date: Mar. 17, 2005

(65) Prior Publication Data

US 2007/0013322 A1 Jan. 18, 2007

Related U.S. Application Data

(60) Provisional application No. 60/500,271, filed on Sep. 4, 2003.

(51) Int. Cl.
*G05F 1/00* (2006.01)

(52) U.S. Cl. ..... 315/309; 315/291; 315/224; 315/308; 315/307; 315/312; 363/21.17; 323/285

(58) Field of Classification Search ..... 315/219, 315/224, 225, 291, 307–309, 247, 209 R, 315/246, 312; 323/280–285, 298, 312–314; 363/21.12, 21.15, 21.17, 95, 97
See application file for complete search history.

(56) References Cited

U.S. PATENT DOCUMENTS

| | | | | |
|---|---|---|---|---|
| 5,334,916 | A * | 8/1994 | Noguchi | 315/309 |
| 6,127,783 | A | 10/2000 | Pashley et al. | |
| 6,150,771 | A | 11/2000 | Perry | |
| 6,351,079 | B1 | 2/2002 | Willis | |
| 6,510,995 | B2 * | 1/2003 | Muthu et al. | 235/454 |
| 7,751,282 | | 6/2003 | Tripathi et al. | |
| 7,038,594 | B2 * | 5/2006 | Voreis et al. | 340/815.45 |
| 7,276,861 | B1 * | 10/2007 | Shteynberg et al. | 315/291 |
| 2002/0097000 | A1 | 7/2002 | Muthu et al. | |
| 2002/0145041 | A1 | 10/2002 | Muthu et al. | |

FOREIGN PATENT DOCUMENTS

| | | | |
|---|---|---|---|
| EP | 05163989 | A2 | 12/1992 |
| WO | WO02/074017 | A1 | 9/2002 |

* cited by examiner

*Primary Examiner*—Haissa Philogene

(57) ABSTRACT

A LED based lighting system (20) employs a LED load temperature sensor (40) for generating a temperature-sensing signal (TSS) indicative of an operational temperature of the LED load (10), a LED current sensor (50) for generating a current-sensing signal (CSS) indicative of a flow of the LED current ($I_{LED}$) through the LED load (10), and a LED driver (30) for regulating the flow of the LED current ($I_{LED}$) through the LED load (10) as a function a mixture of the current-sensing signal (CSS) and the temperature-sensing signal (TSS). The system (20) can further employ a driver disable notifier (80) and a LED driver disabler (90), or alternatively, a fuse network (100) for disabling the LED driver (30) upon a detection of a fault condition of the system (20).

20 Claims, 7 Drawing Sheets

LED TEMPERATURE-DEPENDENT POWER SUPPLY SYSTEM AND METHOD

CROSS REFERENCE TO RELATED APPLICATION

This application claims the benefit of U.S. provisional application Ser. No. 60/500,271 filed Sep. 4, 2003, which the entire subject matter is incorporated herein by reference.

FIELD OF THE INVENTION

The present invention generally relates to light-emitting diode ("LED") light sources. The present invention specifically relates to a power supply system for LED light sources employed within lighting devices (e.g., a traffic light).

BACKGROUND OF THE INVENTION

Most conventional traffic lighting systems employ incandescent bulbs as light sources. Typically, a power disable notifying system is utilized to detect bulb malfunction. Unfortunately, energy consumption and maintenance of incandescent bulb systems is unacceptably high. As a result, LEDs are rapidly replacing incandescent bulbs as the light source for traffic signals. Typically, LEDs consume ten percent (10%) of the power consumed by incandescent bulbs when providing the same light output (e.g., 15 watts vs. 150 watts). Additionally, LEDs experience a longer useful life as compared to incandescent bulbs resulting in a reduction in maintenance.

SUMMARY OF THE INVENTION

The use of LEDs as the light source for traffic signals has resulted in development of LED power supplies, which convert an alternating current (AC) voltage input (e.g., 120 VAC) to a direct current (DC) voltage input. The present invention advances the art of supplying power to LED traffic lighting systems.

One form of the present invention is a LED temperature-dependent power supply system comprising a LED driver module, and a temperature-dependent current control module. The LED driver module regulates a flow of a LED current through a LED load as a function of a temperature-dependent feedback signal. The temperature-dependent current control module generates the temperature-dependent feedback signal as a function of the flow of LED current through the LED load and an operating temperature of the LED load. The temperature-dependent current control module is in electrical communication with the power supply to communicate the temperature-dependent feedback signal to the LED driver module.

The term "electrical communication" is defined herein as an electrical connection, electrical coupling or any other technique for electrically applying an output of one device (e.g., the temperature-dependent current control module) to an input of another device (e.g., the LED driver module).

A second form of the present invention is a LED temperature-dependent power supply method involving a generation of a current-sensing signal indicative of a flow of a LED current through a LED load, a generation of a temperature-sensing signal indicative of an operating temperature of the LED load, and a regulation of the flow of the LED current through the LED load as a function of a mixture of the current-sensing signal and the temperature-sensing signal.

The term "mixture" is defined herein as a generation of an output signal (e.g., the temperature-dependent feedback signal) having a mathematical relationship with each input signal (e.g., the current-sensing signal and the temperature-sensing signal).

The foregoing forms as well as other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

DETAILED DESCRIPTION

Figure 1:
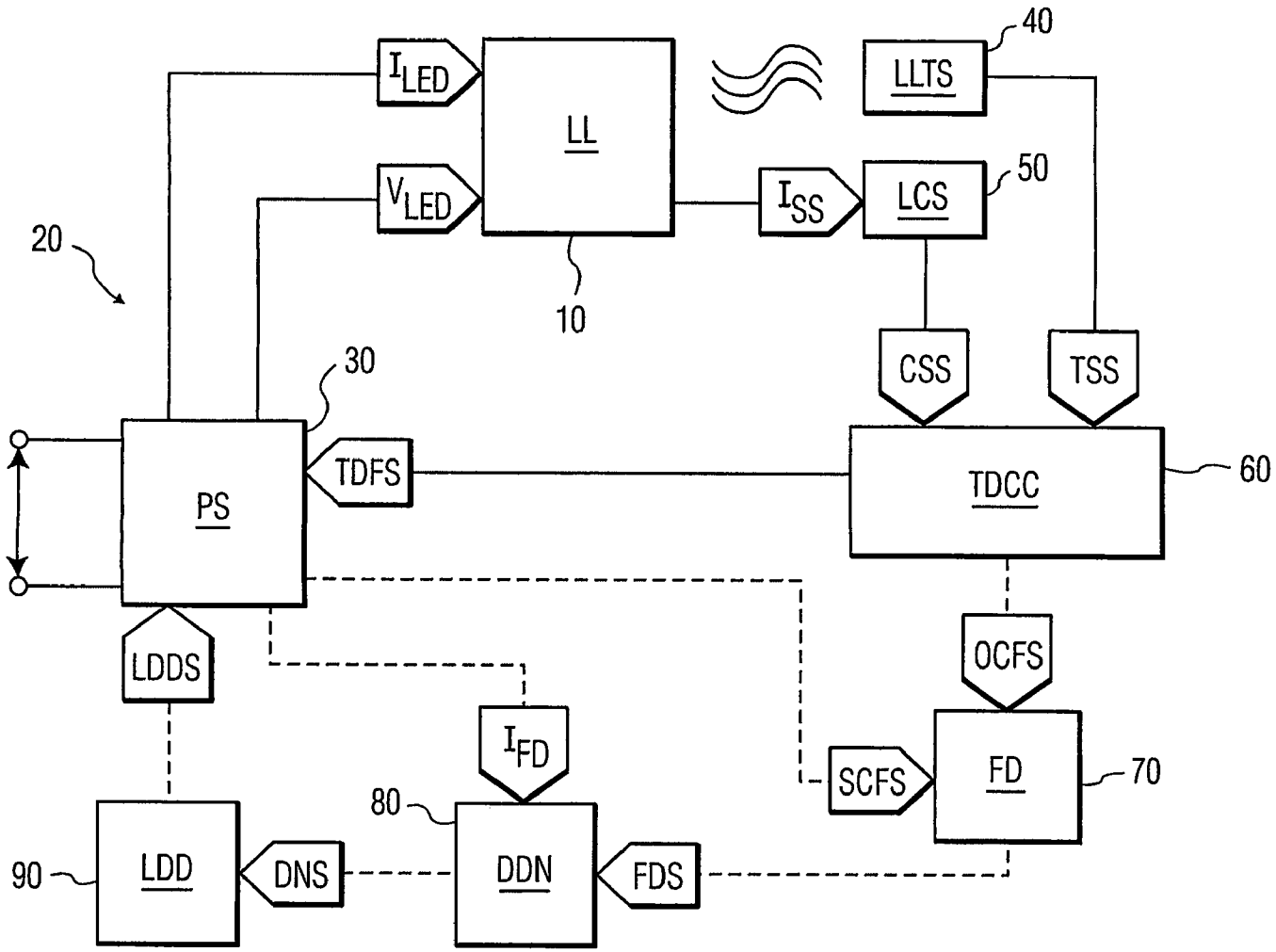
FIG. 1 illustrates a block diagram of a LED temperature-dependent power supply system in accordance with a first embodiment of the present invention.

A LED based lighting system 20 (e.g., a traffic light) as illustrated in FIG. 1 controls a flow of a LED current $I_{LED}$ through a LED load ("LL") 10 of one or more LEDs in response to an input voltage in the form of either an "ON" state input voltage $V_{ON}$ or an "OFF" stage input voltage $V_{OFF}$. To this end, system 20 employs a LED driver ("LD") 30, a LED load temperature sensor ("LLTS") 40, a LED current sensor ("LCS") 50, a temperature-dependent current controller ("TDCC") 60, a fault detector ("FD") 70, a driver disable notifier ("DDN") 80 and a LED driver disabler ("LDD") 90.

LED driver 30 is an electronic module structurally configured to apply a LED voltage $V_{LED}$ to LED load 10 and to regulate a flow of LED current $I_{LED}$ through LED load 10 as a function of operating temperature of LED load 10 and the flow of LED current $I_{LED}$ through LED load 10 as indicated by a temperature-dependent feedback signal TDFS communicated to LED driver 30 by control controller 60. The amperage level of LED current $I_{LED}$ exceeds a minimum forward current threshold for driving LED load 10 in emitting a light whenever the "ON" state input voltage $V_{ON}$ is applied to LED driver 30. The amperage level of LED current $I_{LED}$ is less than the minimum forward current threshold for driving LED load 10 in emitting a light whenever the "OFF" state input voltage $V_{OFF}$ is applied to LED driver 30.

The manner in which LED driver 30 regulates the flow of LED current $I_{LED}$ through the LED load 10 is without limit. In one embodiment, LED driver 30 implements a pulse-width modulation technique in regulating the flow of the LED current $I_{LED}$ through LED load 10 where the implementation of the pulse-width modulation technique is based on temperature-dependent feedback signal TDFS.

LED driver 30 is also structurally configured in the to generate a short condition fault signal SCFS whenever LED load 10 is operating as a short circuit. LED driver 30 is in electrical communication with fault detector 70 to communicate short condition fault signal SCFS to fault detector 70 upon a generation of short condition fault signal SCFS by LED driver 30. In one embodiment, an operation of LED load 10 operating as a short circuit encompasses a low LED voltage condition whereby the voltage level of LED voltage $V_{LED}$ is insufficient for driving LED load 10 in emitting a light during an application of the "ON" state input voltage $V_{ON}$ to LED driver 30.

The manner in which LED driver 30 generates the short condition fault signal SCFS is without limit. In one embodiment, LED voltage $V_{LED}$ is communicated to fault detector 70 whereby LED voltage $V_{LED}$ being below a short condition fault threshold constitutes a generation of the short condition fault signal SCFS.

Sensor 40 is an electronic module structurally configured to sense an operating temperature of LED load 10, and to generate a temperature-sensing signal TSS that is indicative of the operating temperature of LED load 10 as sensed by sensor 40. Sensor 40 is in thermal communication with LED load 10 to thereby sense the operating temperature of LED load 10, and is in electrical communication with current controller 60 to communicate temperature-sensing signal TSS to current controller 60. The term "thermal communication" is defined herein as a thermal coupling, a spatial disposition, or any other technique for facilitating a transfer of thermal energy from one device (e.g., LED load 10) to another device (e.g., sensor 40).

The manner in which sensor 40 senses the operating temperature of LED load 10 and generates temperature-sensing signal is without limit. In one embodiment, sensor 40 employs an impedance network having a temperature-coefficient resistor, positive or negative, fabricated on a LED board supporting LED load 10 whereby the temperature-coefficient resistor is in thermal communication with LED load 10.

Sensor 50 is an electronic module structurally configured to sense the flow of LED current $I_{LED}$ through LED load 10, and to generate a current-sensing signal CSS that is indicative of the flow of the LED current $I_{LED}$ through LED load 10 as sensed by sensor 40. Sensor 50 is in electrical communication with current controller 60 to communicate current-sensing signal CSS to current controller 60.

The manner in which sensor 50 senses the flow of LED current $I_{LED}$ through LED load 10, and generates current-sensing signal CSS is without limit. In one embodiment, sensor 50 is in electrical communication with LED load 10 to pull a sensing current $I_{SS}$ from LED load 10 as illustrated in FIG. 1 whereby sensor 50 generates current sensing signal CSS based on sensing current $I_{SS}$.

Current controller 60 is an electronic module structurally configured to generate temperature-dependent feedback signal TDFS as a function of the operating temperature of the LED load 10 as indicated by temperature-sensing signal TSS and the flow of the LED current $I_{LED}$ through LED load 10 as indicated by current-sensing signal CSS. Current controller 60 is in electrical communication with LED driver 30 whereby LED driver 30 regulates the flow of the LED current $I_{LED}$ through LED load 10 as previously described herein.

The manner in which current controller 60 generates temperature-dependent feedback signal TDFS is without limit. In one embodiment, current controller 60 mixes the temperature sensing signal TSS and the current sensing signal CSS to yield the temperature-dependent feedback signal TDFS.

Current controller 60 is also structurally configured to generate an open condition fault signal OCFS whenever current sensing signal CSS indicates LED load 10 is operating as an open circuit. Current controller 60 is in electrical communication with fault detector 70 to communicate open condition fault signal OCFS to fault detector 70 upon a generation of open condition fault signal OCFS by current controller 60.

The manner in which current controller 60 generates open condition fault signal OCFS is without limit. In one embodiment, current controller 60 generates open condition fault signal OCFS in response to current sensing signal CSS being below an open condition fault threshold.

Fault detector 70 is an electronic module structurally configured to generate a fault detection signal FDS as an indication of a generation of short circuit condition signal SCFS by LED driver 30 or a generation of open condition fault signal OCFS by current controller 60. Fault detector 70 is in electrical communication with driver disable notifier 80 to communicate fault detection signal FDS to driver disable notifier 80 upon a generation of fault detection signal FDS by fault detector 70.

The manner in which fault detector 70 generates fault detection signal FDS is without limit. In one embodiment, fault detector 70 employs one or more electronic switches that transition from a first state (e.g., an "OPEN" switch state) to a second state (e.g., "CLOSED" switch state) in response to either short circuit condition signal SCFS or open circuit condition signal OCFS being communicated to fault detector 70 by LED driver 30 or current controller 60, respectively.

Driver disable notifier 80 is an electronic module structurally configured to draw a fault detection current $I_{FD}$ from LED driver 30 in response to a generation of fault detection signal FDS by fault detector 70, and to generate a disable notification signal DNS upon an amperage of fault detection current $I_{FD}$ exceeding a fault detection threshold. Driver disable notifier 80 is in electrical communication with LED driver disabler 90 to communicate disable notification signal DNS to LED driver disabler 90 upon a generation of disable notification signal DNS by driver disable notifier 80.

The manner in which driver disable notifier 80 generates disable notification signal DNS is without limit. In one embodiment, driver disable notifier 80 employs one or more electronic switches that transition from a first state (e.g., an "OPEN" switch state) to a second state (e.g., "CLOSED" switch state) to pull fault detection current $I_{FD}$ from LED driver 30 in response to fault detection signal FDS being communicated to driver disable notifier 80 by fault detector 70. This embodiment further employs a fuse component (e.g., a fusistor) whereby fault detection current $I_{FD}$ will blow open the fusistor to generate the disable notification signal DNS.

LED driver disabler 90 is an electronic module structurally configured to generate a LED-driver disable signal LDDS as an indication of a generation of disable notification signal DNS by driver disable notifier 80. LED driver disabler 90 is in electrical communication with LED driver 30 to communicate LED driver disable signal LDDS to LED driver 30 upon a generation of LED driver disable signal LDDS by LED driver disabler 90.

The manner in which LED driver disabler 90 generates LED driver disable signal LDDS is without limit. In one embodiment, LED driver disabler 90 employs one or more electronic switches that transition from a first state (e.g., an "OPEN" switch state) to a second state (e.g., "CLOSED" switch state) to generate LED driver disable signal LDDS in response to disable notification signal DNS being communicated to LED driver disabler 90 by driver disable notifier 80.

An "ON" state operation and an "OFF" stage operation of system 20 will now be described herein.

An "ON" state operation of system 20 involves an application of "ON" state input voltage $V_{ON}$ to LED driver 30 whereby LED driver 30 regulates the flow of LED current $I_{LED}$ through LED load 10 to thereby drive LED load 10 to emit a light. This current regulation by LED driver 30 will vary between an upper limit and a lower limit for LED current $I_{LED}$ based on the sensed operating temperature of LED load 10 and the sensed flow of LED current $I_{LED}$ through LED load 10. This current regulation by LED load 10 will be continuous until such time (1) the "OFF" state input voltage $V_{OFF}$ is applied to LED driver 30, (2) the LED load 10 operates as an open circuit, or (3) the LED load 10 operates as a short circuit, which, as previously described herein, encompasses a low LED voltage condition whereby the voltage level of LED voltage $V_{LED}$ is insufficient for driving LED load 10 in emitting a light during an application of the "ON" state input voltage $V_{ON}$ to LED driver 30. In one embodiment, if a fault condition is detected during the "ON" state operation, then fault detection current $I_{FS}$ flows through a fuse component of driver disable notifier 80 until the fuse component blows open to thereby disable LED driver 30.

An "OFF" state operation of system 20 involves an application of an input voltage (not shown) via a high impedance network (not shown) (e.g., 20 KΩ). A conventional conflict monitor (not shown) is utilized to measure a voltage across input terminals of LED driver 30. In one embodiment, if a fuse component of driver disable notifier 80 had blown open during the "ON" state operation as an indication of a fault condition of system 20, then the voltage measured across the input terminals of LED driver 30 will exceed a conflict monitor voltage threshold for facilitating a detection of the fault condition by the conflict monitor. Conversely, if the fuse component of driver disable notifier 80 had not blow open during the "ON" state operation, then the voltage measured across the input terminals of LED driver 30 will be less than the conflict monitor voltage threshold whereby the conflict monitor detects a no-fault operation status of system 20.

In practice, structural configurations of LED driver 30, sensor 40, sensor 50, temperature-dependent current controller 60, fault detector 70, driver disable notifier 80 and LED driver disabler 90 are dependent upon a particular commercial implementation of system 20.

Figure 2:
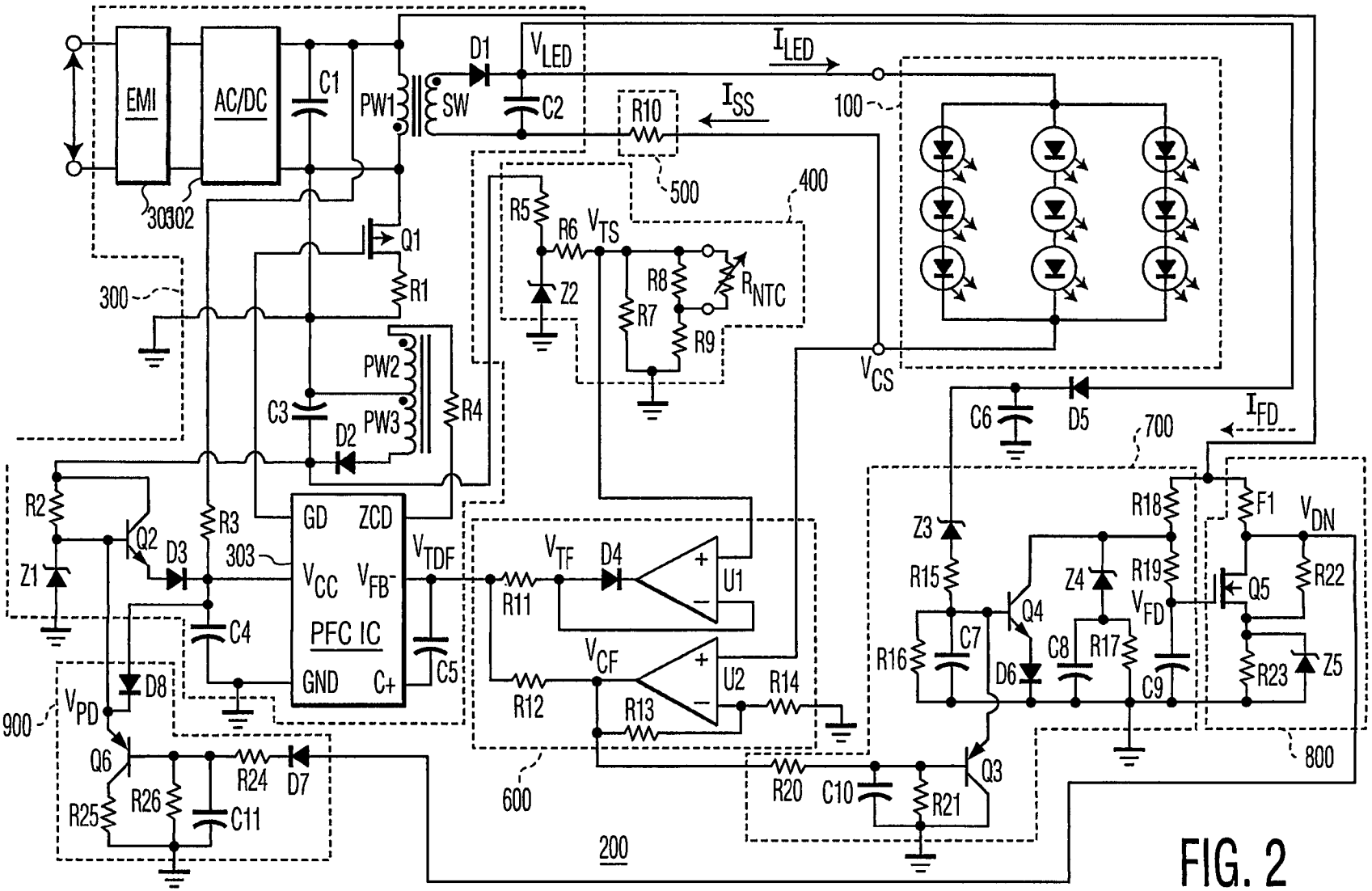
FIG. 2 illustrates one embodiment in accordance with the present invention of the LED temperature-dependent power supply system illustrated in FIG. 1.

FIG. 2 illustrates one embodiment of system 20 (FIG. 1) as a system 200 that employs LED driver 300, sensor 400, sensor 500, a temperature-dependent current controller 600, a fault detector 700, a driver disable notifier 800 and a LED driver disabler 900.

LED driver 300 employs an illustrated structural configuration of a conventional electromagnetic filter ("EMI") 301, a conventional power converter ("AC/DC") 302, capacitors C1-C5, windings PW1-PW3 and SW1 of a transformer, diodes D1-D3, a zener diode Z1, resistors R1-R4, an electronic switch in the form of a N-Channel MOSFET Q1, an electronic switch in the form of a NPN bipolar transistor Q2, and a conventional power factor correction integrated circuit ("PFC IC") 303 (e.g., model L.6561 manufactured by ST Microelectronics, Inc.).

Circuit 303 has a gate driver output GD electrically connected to a gate of MOSFET Q1 to control an operation of MOSFET Q1 as a switch. Reset coil PW2 is electrically connected to a reset input ZCD of circuit 303 to conventionally provide a reset signal (not shown) to circuit 303. An emitter terminal of transistor Q2 is electrically connected via diode D3 to power input $V_{CC}$ of circuit 303 to conventionally provide a power signal (not shown) to circuit 303. Capacitor C5 is electrically connected between a feedback input $V_{FB}$ and a compensation input C+ of circuit 303 to facilitate an application to feedback input $V_{FB}$ of temperature-dependent feedback signal TDFS (FIG. 1) in the form of a temperature-dependent feedback voltage $V_{TDFS}$.

Sensor 400 employs an illustrated structural configuration of resistors R5-R9, a zener diode Z2, and a negative temperature coefficient resistor $R_{NTC}$ A thermal communication between resistor $R_{NTC}$ and a LED load 100 facilitates a generation of temperature sensing signal TSS (FIG. 1) in the form of a temperature sensing voltage $V_{TS}$. In one embodiment, resistor $R_{NTC}$ is formed on a LED board supporting LED load 100 to thereby establish the thermal communication between resistor $R_{NTC}$ and LED load 100.

Figure 3:
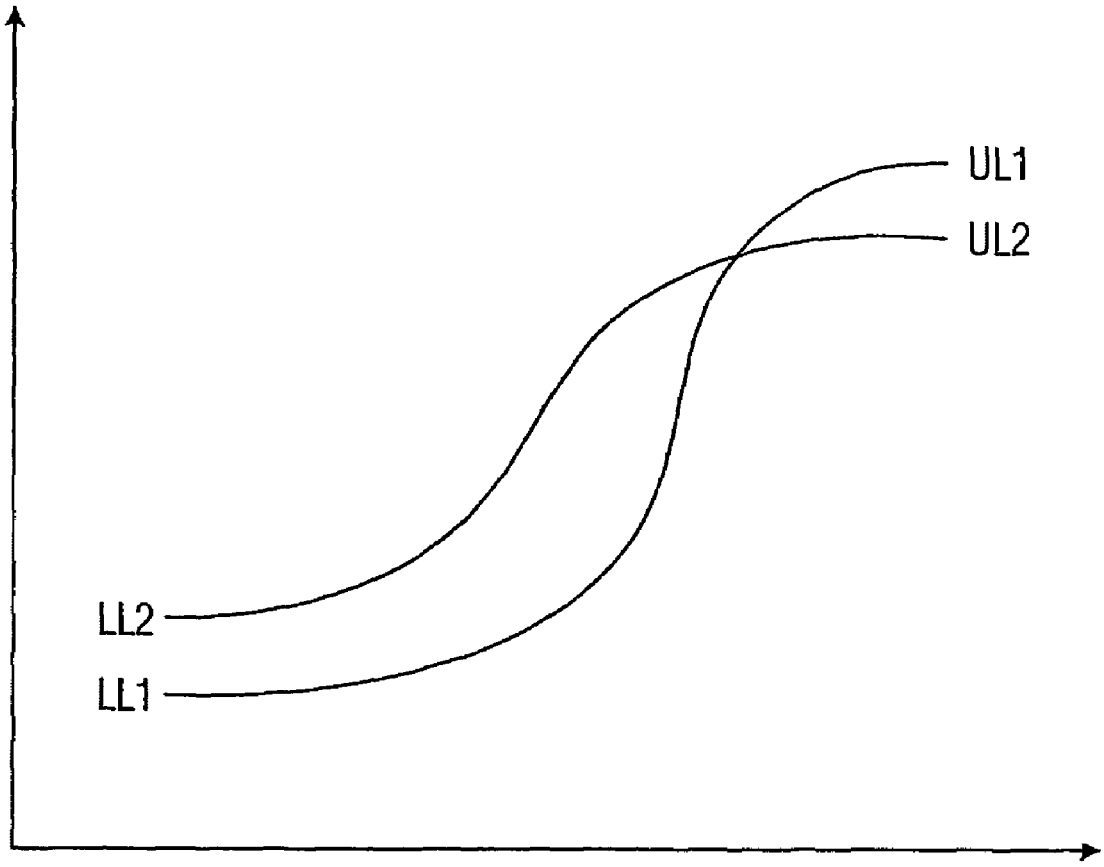
FIG. 3 illustrates an exemplary graphical relationship of a LED current and a negative temperature coefficient network illustrated in FIG. 2.

The illustrated structural configuration of sensor 400 enables a selection of one of many LED operational relationships between the resistive value of resistor $R_{NTC}$ and the flow of LED current $I_{LED}$ through LED load 100. FIG. 3 illustrates a pair of exemplary curves depicting the operational relationships between the resistive value of resistor $R_{NTC}$ and the flow of LED current $I_{LED}$ through LED load 100. The first curve is shown as having an upper limit UL1 and a lower limit LL1. The second curve is shown as having an upper limit UL2 and a lower limit LL2. Those having ordinary skill in the art will appreciate the required light output of LED load 100 determines the desired operational relationship between the resistive value of resistor $R_{NTC}$ and the flow of LED current $I_{LED}$ through LED load 100.

Sensor 500 conventionally employs a sense resistor R10 to facilitate a generation of current sensing signal CSS (FIG. 1) in the form of current sense voltage $V_{CS}$.

Current controller 600 employs an operational amplifier U1, an operational amplifier U2, resistors R11-R14, and a diode D4. A non-inverting input of operational amplifier U1 is electrically connected to sensor 400 whereby temperature-sensing voltage $V_{TS}$ is applied to the non-inverting input of operational amplifier U1. A non-inverting input of operational amplifier U2 is electrically connected to sensor 500 whereby current sensing voltage $V_{CS}$ is applied to the non-inverting input of operational amplifier U2. Temperature-dependent feedback voltage $V_{TDF}$ is generated as a mixture of a temperature feedback voltage $V_{TF}$ generated by operational amplifier U1 and a current feedback voltage $V_{CF}$ generated by operational amplifier U2.

In one embodiment, an internal reference signal of circuit 303 is 2.5 volts and the illustrated structural configuration of current controller 600 is designed to force temperature-dependent feedback voltage $V_{TDF}$ to be 2.5 volts. In design, at the lower end of the operating temperature range of LED load 100 operational amplifier U1 is designed to generate temperature sensing voltage $V_{TS}$ approximating 2.5 volts and a design of an output of operational amplifier U2 in generating current sensing voltage $V_{CS}$ is adjusted to achieve a lower LED current limit, such as, for example, lower limits LL1 and LL2 illustrated in FIG. 3. In operation, the generation of temperature sensing voltage $V_{TS}$ and current sensing voltage $V_{CS}$ is in accordance with the mathematical relationship [1]:

$$(V_{CF}-2.5\text{ volts})/R12=(2.5\text{ volts}-V_{TF})/R11 \quad [1]$$

where a minimum level of temperature sensing signal $V_{TS}$ achieves a suitable upper LED current limit, such as, for example upper limits UL1 and UL2 illustrated in FIG. 3.

Fault detector 700 employs an illustrated structural configuration of resistors R15-R21, capacitors C7-C10, a diode D6, a pair of zener diode Z3 and Z4, an electronic switch in the form of a PNP bipolar transistor Q3, and an electronic switch in the form of a NPN bipolar transistor Q4.

Resistor R20 is electrically connected to the output of operational amplifier U2 to establish the electric communication between current controller 600 and fault detector 700. Current sensing voltage $V_{CS}$ is below the open condition fault threshold OCFT (e.g., 0 volts) whenever LED load 100 is operating as a short circuit. As such, current sensing voltage $V_{CF}$ constitutes open condition fault signal OCFS (FIG. 1) whenever current sensing voltage $V_{CF}$ below the open condition fault threshold.

Zener diode Z3 is electrically connected to an output of LED driver 300 via a diode D5 and a capacitor C6 to establish an electrical communication between LED driver 300 and fault detector 700. LED voltage $V_{LED}$ constitutes the short circuit fault signal SCFS (FIG. 1) whenever LED voltage $V_{LED}$ is below the short condition fault threshold SCFT (e.g., 4 volts), such as, for example, whenever LED load is operating as a short circuit.

Driver disable notifier 800 employs an illustrated structural configuration of fusistor F1, resistors R22 and R23, zener diode Z5, and an electronic switch in the form of a N-Channel MOSFET Q5. Fusistor F1 is electrically connected to LED driver 300 to thereby establish an electrical communication between LED driver 300 and driver disable notifier 800. A gate terminal of MOSFET Q5 is electrically connected to fault detector 700 to establish an electrical communication between fault detector 700 and driver disable notifier 800.

A fault detection current $I_{FD}$ flows from LED driver 300 through fusistor F1 whenever MOSFET Q5 is ON. Fusistor F1 is designed to blow whenever the flow of fault detection current $I_{FD}$ reaches a specified amperage level. Disable notification signal DNS (FIG. 1) in the form of a disable notification voltage $V_{DN}$ is generated upon a blowing of fusistor F1.

LED driver disabler 900 employs the illustrated structural configuration of resistors R24-R26, a capacitor C11, a pair of diodes D7 and D8, and an electronic switch in the form of PNP bipolar transistor Q6. Diode D7 is electrically connected to fusistor F1 to thereby establish an electrical communication between driver disable notifier 800 and LED driver disabler 900. An emitter terminal of transistor Q6 and diode D8 are electrically connected to a base terminal of transistor Q2, and diode D8 is further electrically connected to power input $V_{CC}$ of circuit 303 to establish an electrical communication between LED driver 300 and LED driver disabler 900. Power disable signal PDS (FIG. 1) in the form of power disable voltage $V_{PD}$ is generated at the base terminal of transistor Q2 upon a generation of disable notification voltage $V_{DN}$ by driver disable notifier 800.

Figure 4:
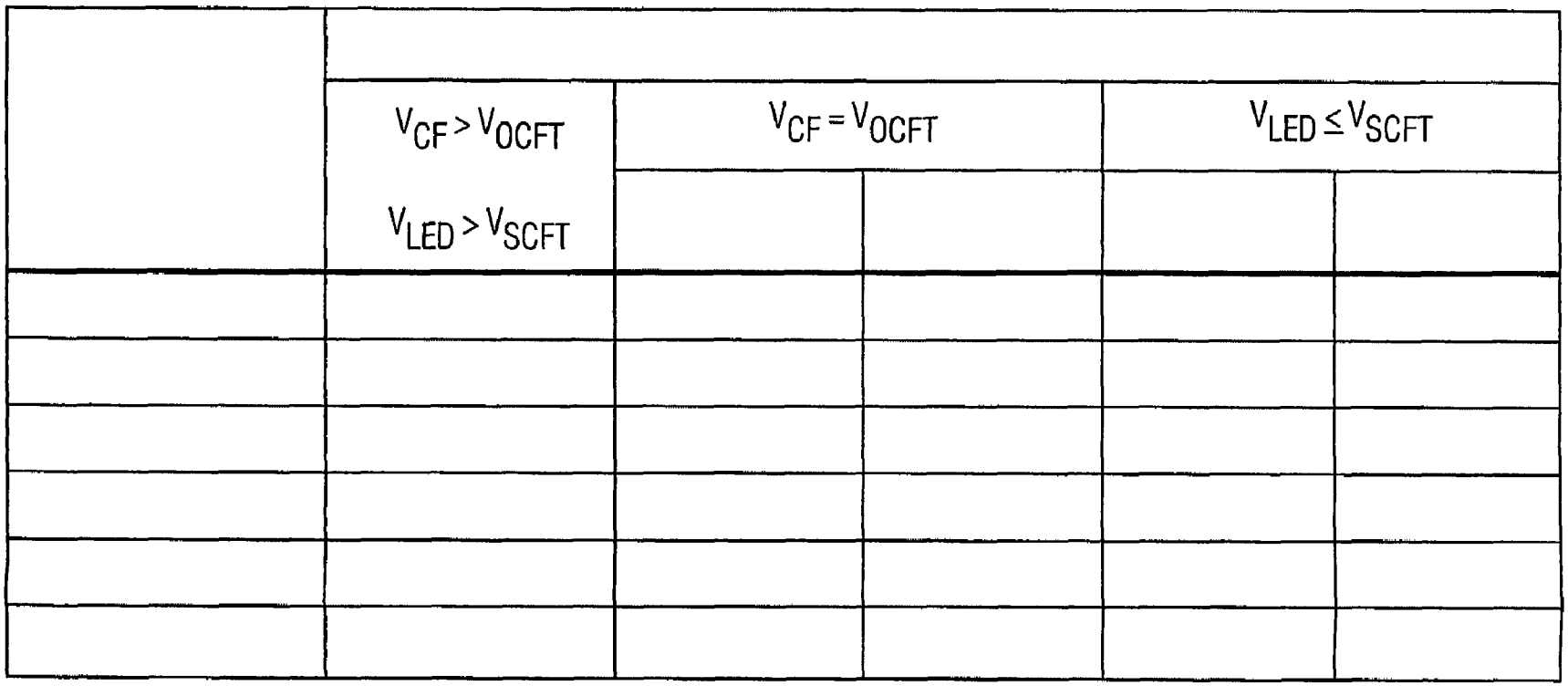
FIG. 4 illustrates a table listing various operational states of transistors employed by the temperature-dependent power supply system illustrated in FIG. 2.

An "ON" state operation of system 200 will now be described herein with reference to FIG. 4.

An "ON" state operation of system 200 involves an application of "ON" state input voltage $V_{ON}$ to EMI filter 301 whereby LED driver 300 regulates the flow of LED current $I_{LED}$ through LED load 100 to thereby drive LED load 100 to emit a light. Current feedback voltage $V_{CF}$ being greater than an open condition fault threshold voltage $V_{OCFT}$ is indicative of an absence of LED load 100 operating as an open circuit. LED voltage $V_{LED}$ being greater than short condition fault threshold voltage $V_{SCTF}$ is indicative of an absence of LED load 100 operating in a low LED voltage condition, in particular as a short circuit. As such, MOSFET Q1 and transistor Q2 are turned ON whereby circuit 303 controls an implementation of a pulse width modulation of the gate signal applied to MOSFET Q1.

Current feedback voltage $V_{CF}$ being equal to open condition fault threshold voltage $V_{OCFT}$ is indicative of a presence of LED load 100 operating as an open circuit. In such a case, transistor Q3 is turned ON, which turns transistor Q4 OFF. This ensures MOSFET Q5 is fully turned ON. As a result, fault detection current $I_{FD}$ will flow through fusistor F1 until fusistor F1 is blown open. Upon fusistor F1 blowing open, transistor Q6 is turned ON to thereby turn pull the base terminal of transistor Q2 and capacitor C4 to a low voltage state whereby LED driver 300 is disabled and MOSFET Q1 is turned OFF.

LED voltage $V_{LED}$ being less than or equal to short condition fault threshold voltage $V_{SCFT}$ is indicative of a presence of LED load 100 operating in a low LED voltage condition, particularly as a short circuit. In this case, transistor Q4 turns OFF to turn MOSFET Q5 fully ON. As a result, fault detection current $I_{FD}$ will flow through fusistor F1 until fusistor F1 is blown open. Again, upon fusistor F1 blowing open, transistor Q6 is turned ON to thereby turn pull the base terminal of transistor Q2 and capacitor C4 to a low voltage state whereby LED driver 300 is disabled and MOSFET Q1 is turned OFF.

If a fault condition is detected during the "ON" state operation, then fusistor F1 is blown and LED driver 30 is disabled. Specifically, fusistor F1 is blown open by keeping MOSFET Q5 turned on whereby fault detection current $I_{FD}$ increases until fusistor F1 blows open.

An "OFF" state operation of system 200 involves an application of an input voltage (not shown) via a high impedance network (not shown) (e.g., 20 KΩ). A conventional conflict monitor (not shown) is utilized to measure a voltage across input terminals of LED driver 300. If fusistor F1 had blown open during the "ON" state operation as an indication of a fault condition of system 200, then the voltage measured across the input terminals of LED driver 300 will exceed a conflict monitor voltage threshold for facilitating a detection of the fault condition by the conflict monitor. If fusistor F1 had not blow open during the "ON" state operation, then the conflict monitor voltage measured across the input terminals of LED driver 300 will be less than the voltage threshold whereby the conflict monitor detects a no-fault operation status of system 200.

Figure 5:
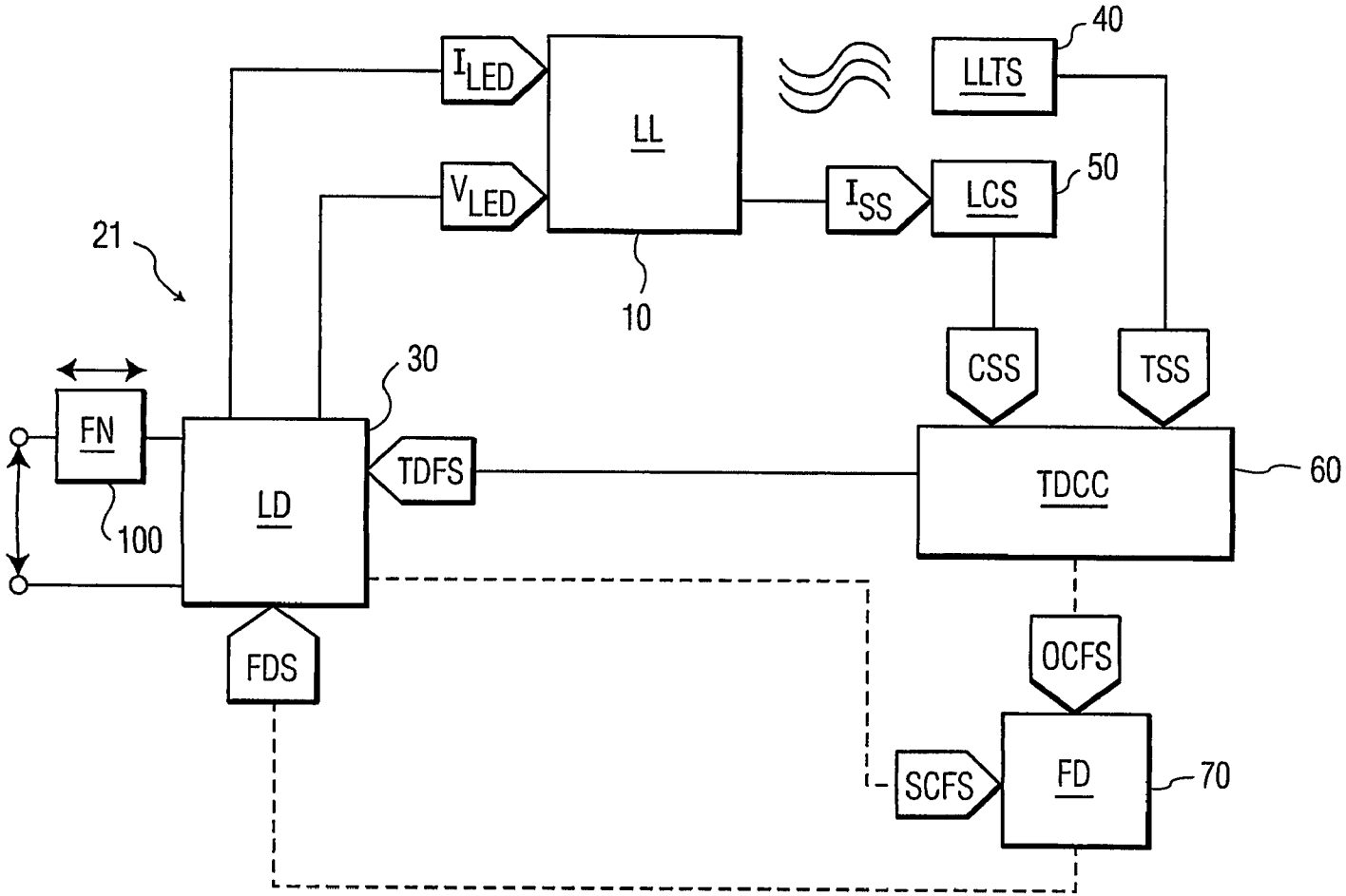
FIG. 5 illustrates a block diagram of a LED temperature-dependent power supply system in accordance with a second embodiment of the present invention.

A LED based lighting system 21 (e.g., a traffic light) as illustrated in FIG. 5 controls a flow of a LED current $I_{LED}$ through a LED load ("LL") 10 in response to an input voltage in the form of either an "ON" state voltage $V_{ON}$ or an "OFF" stage voltage $V_{OFF}$. To this end, system 20 employs power supply ("PS") 30, LED load temperature sensor ("LLTS") 40, LED current sensor ("LCS") 50, a temperature-dependent current controller ("TDCC") 60, fault detector ("FD") 70, and a fuse network ("FD") 100.

LED driver 30, sensor 40, sensor 50, current controller 60 and fault detector 70 operate as previously described herein in connection with FIG. 1, except fault detector 70 is in electrical communication with LED driver 30 to communicate fault detection signal FDS to LED driver 30. In response to fault detection signal FDS, LED driver 30 operates to increase an amperage level of an input current $I_{IN}$ whereby fuse network 100, which is an electronic module structurally configured to include one or more fuse components (e.g., a fusistor), blows open to disable LED driver 30.

An "ON" state operation and an "OFF" stage operation of system 21 will now be described herein.

An "ON" state operation of system 20 involves an application of "ON" state input voltage $V_{ON}$ to LED driver 30 via fuse network 100 whereby LED driver 30 regulates the flow of LED current $I_{LED}$ through LED load 10 to thereby drive LED load 10 to emit a light. This current regulation by LED driver 30 will vary between an upper limit and a lower limit for LED current $I_{LED}$ based on the sensed operating temperature of LED load 10 and the sensed flow of LED current $I_{LED}$ through LED load 10. This current regulation by LED load 10 will be continuous until such time (1) the "OFF" state input voltage $V_{OFF}$ is applied to LED driver 30, (2) the LED load 10 operates as an open circuit, or (3) the LED load 10 operates as a short circuit, which, as previously described herein, encompasses a low LED voltage condition whereby the voltage level of LED voltage $V_{LED}$ is insufficient for driving LED load 10 in emitting a light during an application of the "ON" state input voltage $V_{ON}$ to LED driver 30.

An "OFF" state operation of system 21 involves an application of an input voltage (not shown) via a high impedance network (not shown) (e.g., 20 KΩ). A conventional conflict monitor (not shown) is utilized to measure a voltage across input terminals of LED driver 30. In one embodiment, if fuse network 100 had blown open during the "ON" state operation as an indication of a fault condition of system 21, then the voltage measured across the input terminals of LED driver 30 will exceed a conflict monitor voltage threshold for facilitating a detection of the fault condition by the conflict monitor. Conversely, if the fuse network 100 had not blow open during the "ON" state operation, then the voltage measured across the input terminals of LED driver 30 will be less than the conflict monitor voltage threshold whereby the conflict monitor detects a no-fault operation status of system 21.

Alternatively, the conflict monitor could measure an "ON" state input line current $I_{IN}$ to detect any fault condition of system 21. In the case, if fuse network 100 blows open during the "ON" state operation, then the ON" state input line current $I_{IN}$ will be less than a conflict monitor current threshold for facilitating a detection of the fault condition by the conflict monitor. Conversely, if the fuse network 100 does not blow open during the "ON" state operation, then the ON" state input line current $I_{IN}$ will be greater than the conflict monitor current threshold whereby the conflict monitor detects a no-fault operation status of system 21.

In practice, structural configurations of LED driver 30, sensor 40, sensor 50, temperature-dependent current controller 60, fault detector 70, and fuse network 100 are dependent upon a particular commercial implementation of system 20.

Figure 6:
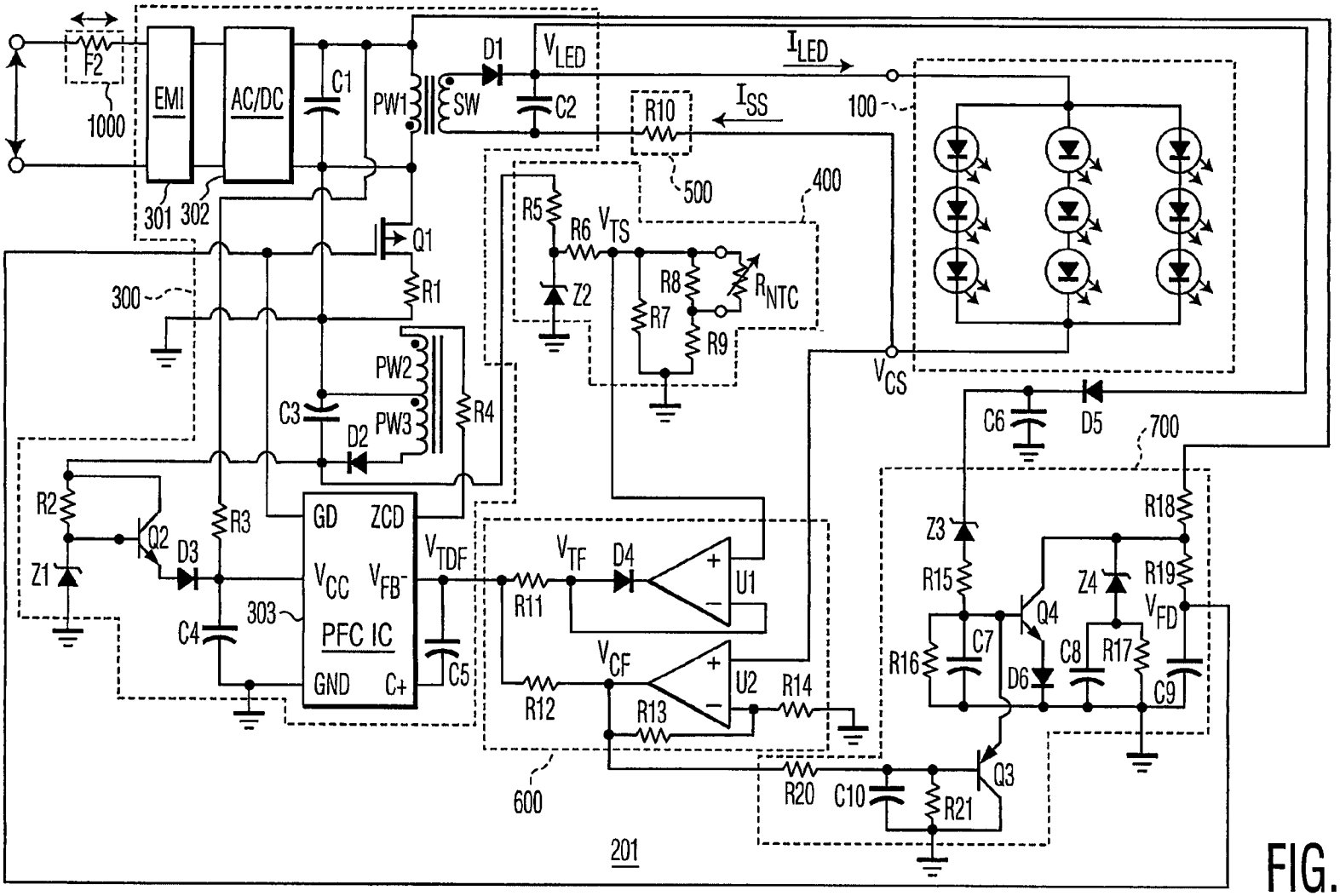
FIG. 6 illustrates one embodiment in accordance with the present invention of the LED temperature-dependent power supply system illustrated in FIG. 5.

FIG. 6 illustrates one embodiment of system 21 (FIG. 5) as a system 201 that employs LED driver 300, sensor 400, sensor 500, temperature-dependent current controller 600, fault detector 700, and a fuse network 1000. LED driver 300, sensor 400, sensor 500, current controller 600 and fault detector 700 operate as previously described in connection with FIG. 2. Fuse network 1000 includes a fusistor F2 electrically connected in series between an input terminal and EMI filter 301.

Figure 7:
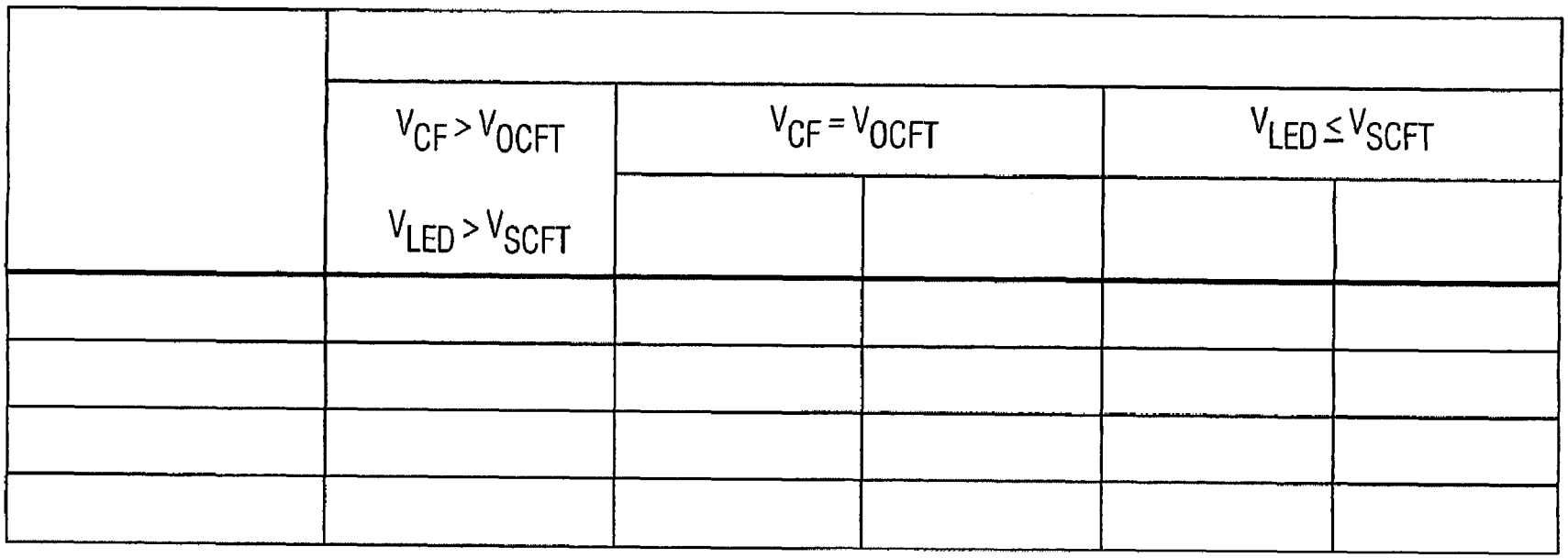
FIG. 7 illustrates a table listing various operational states of transistors employed by the temperature-dependent power supply system illustrated in FIG. 5.

An "ON" state operation of system 201 will now be described herein with reference to FIG. 7.

An "ON" state operation of system 201 involves an application of "ON" state input voltage $V_{ON}$ to EMI filter 301 via fusistor F2 whereby LED driver 300 regulates the flow of LED current $I_{LED}$ through LED load 100 to thereby drive LED load 100 to emit a light. Current feedback voltage $V_{CF}$ being greater than an open condition fault threshold voltage $V_{OCFT}$ is indicative of an absence of LED load 100 operating as an open circuit LED voltage $V_{LED}$ being greater than short condition fault threshold voltage $V_{SCTF}$ is indicative of an absence of LED load 100 operating in a low LED voltage condition, in particular as a short circuit. As such, MOSFET Q1 and transistor Q2 are turned ON whereby circuit 303 controls an implementation of a pulse width modulation of the gate signal applied to MOSFET Q1.

Current feedback voltage $V_{CF}$ being equal to open condition fault threshold voltage $V_{OCFT}$ is indicative of a presence of LED load 100 operating as an open circuit. In such a case, transistor Q3 is turned ON, which turns transistor Q4 OFF. As a result, fault detection voltage $V_{FD}$ is applied to the gate to MOSFET Q1 to thereby pull input current $I_{IN}$ at amperage level sufficient to blow open fusistor F2.

LED voltage $V_{LED}$ being less than or equal to short condition fault threshold voltage $V_{SCFT}$ is indicative of a presence of LED load 100 operating in a low LED voltage condition, particularly as a short circuit. In such a case, transistor Q4 turns OFF to apply fault detection voltage $V_{FD}$ to the gate terminal of MOSFET Q1 whereby LED driver 300 pulls input current $I_{IN}$ at amperage level sufficient to blow open fusistor F2.

An "OFF" state operation of system 201 involves an application of an input voltage (not shown) via a high impedance network (not shown) (e.g., 20 KΩ). A conventional conflict monitor (not shown) is utilized to measure a voltage across input terminals of LED driver 300 In one embodiment, if fusistor F2 had blown open during the "ON" state operation as an indication of a fault condition of system 201, then the voltage measured across the input terminals of LED driver 300 will exceed a conflict monitor voltage threshold for facilitating a detection of the fault condition by the conflict monitor. Conversely, if fusistor F2 had not blow open during the "ON" state operation, then the voltage measured across the input terminals of LED driver 300 will be less than the conflict monitor voltage threshold whereby the conflict monitor detects a no-fault operation status of system 201.

Alternatively, the conflict monitor could measure an "ON" state input line current $I_{IN}$ to detect any fault condition of system 201. In the case, if fusistor F2 blows open during the "ON" state operation, then the ON" state input line current $I_{IN}$ will be less than a conflict monitor current threshold for facilitating a detection of the fault condition by the conflict monitor. Conversely, if fusistor F2 does not blow open during the "ON" state operation, then the ON" state input line current $I_{IN}$ will be greater than the conflict monitor current threshold whereby the conflict monitor detects a no-fault operation status of system 201.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A system for supplying power to an LED load, the system comprising:

a LED driver module operable to regulate a flow of a LED current through the LED load as a function of a temperature-dependent feedback signal;

a current controller module in electric communication with said LED driver module to communicate the temperature-dependent feedback signal to said LED driver module; and a fault detection module in electrical communication with the current controller module, the fault detection module operable to generate a fault detection signal in response to an output signal received from the current controller module, wherein the current controller module is operable to generate the output signal as a function of the flow of the LED current through the LED load, wherein said current controller module is operable to generate the temperature-dependent feedback signal as a function of an operating temperature of the LED load and the flow of the LED current through the LED load.

2. The system of claim 1, wherein said current controller module includes:

means for generating a temperature feedback voltage as a function of a sensed operating temperature of the LED load;

means for generating a current feedback voltage as a function of a sensed flow of the LED current through the LED load; and means for mixing the temperature feedback voltage and the current feedback voltage to yield the temperature-dependent feedback signal.

3. The system of claim 1, wherein said current controller module includes:

an operational amplifier operable to generate a temperature feedback voltage as a function of the operating temperature of the LED load.

4. The system of claim 3, further comprising:

a LED temperature sensor module operable to sense the operating temperature of the LED load and to generate a temperature sensing signal indicative of the operating temperature of the LED load as sensed by said LED temperature sensor module, wherein said LED temperature sensor is in electrical communication with said current controller module to communicate the temperature-sensing signal to said operational amplifier whereby said operational amplifier generates the temperature feedback voltage as a function of the operating temperature of the LED load.

5. The system of claim 4, wherein said temperature sensor module includes:

a temperature coefficient resistor in thermal communication with the LED load to thereby sense the operating temperature of the LED load.

6. The system of claim 1, wherein said current controller module includes:

an operational amplifier operable to generate a current feedback voltage as the function of the flow of the LED current through the LED load.

7. The system of claim 6, further comprising:

a LED current sensor module operable to sense the flow of the LED current through the LED load and to generate a current sensing signal indicative of the flow of the LED current through the LED load as sensed by said LED current sensor module, wherein said LED current sensor module is in electrical communication with said current controller module to communicate the current sensing signal to said operational amplifier whereby said operational amplifier generates the current feedback voltage as the function of the flow of the LED current through the LED load.

8. The system of claim 1, wherein the fault detector module is operable to generate the fault detection signal in response to the LED load operating as an open circuit, and wherein the system further comprises a driver disable notifier in electrical communication with said fault detector module to receive a communication of the fault detection signal from said fault detector module, said driver disable notifier including a fusistor operable to blow open in response to a reception of the fault detection signal by said driver disable notifier.

9. The system of claim 8, further comprising:

a LED driver disabler module operable to disable said LED driver module in response to a blowing open of said fusistor.

10. The system of claim 1, wherein the fault detection module includes means for generating a fault detection voltage as a function of the LED load operating as an open circuit, and wherein the system further comprises a driver disable notifier including a fusistor, and means for blowing open said fusistor in response to a generation of the fault detection voltage.

11. The system of claim 10, further comprising:

means for disabling said LED driver module in response to a blowing open of said fusistor.

12. The system of claim 1, wherein the fault detector module is operable to generate the fault detection signal in response to the LED load operating as a short circuit; and wherein the system further comprises a driver disable notifier in electrical communication with said fault detector module to receive a communication of the fault detection signal by said fault detector module, said driver disable notifier including a fusistor operable to blow open in response to a reception of the fault detection signal by said driver disable notifier.

13. The system of claim 12, further comprising:

a LED driver disabler module operable to disable said LED driver module in response to a blowing open of said fusistor.

14. The system of claim 1, wherein the fault detection module includes means for generating a fault detection voltage as in response to the LED load operating as a short open circuit, and wherein the system further comprises a driver disable notifier including a fusistor, and means for blowing open said fusistor in response to a generation of the fault detection voltage.

15. The system of claim 14, further comprising:

means for disabling said LED driver module in response to a blowing open of said fusistor.

16. The system of claim 1, further comprising:

a fusistor in electrical communication with said LED driver module, wherein said fusistor is operable to blow open in response to the LED load operating as an open circuit, and wherein said LED driver module is disabled in response to a blowing open of said fusistor.

17. The system of claim 1, further comprising:

a fusistor in electrical communication with said LED driver module, wherein said fusistor is operable to blow open in response to the LED load operating as a short circuit, and wherein said LED driver module is disabled in response to a blowing open of said fusistor.

18. A method for supplying power to an LED load, the method comprising:

generating a current-sensing signal indicative of a flow of a LED current through the LED load;

generating a temperature-sensing signal indicative of an operational temperature of the LED load;

regulating the flow of the LED current through the LED load as a function of a mixture of the current-sensing signal and the temperature-sensing signal;

generating, as a function of the current-sensing signal, an output signal indicative of a fault based on an operating condition of the LED load; and generating, in response to the output signal, a fault detection signal to cease the flow of the LED current through the LED load.

19. The method of claim 18, wherein the output signal is indicative of the LED load operating as an open circuit, wherein the method further comprises:

generating a feedback signal indicative of the LED load operating as a short circuit; and generating the fault detection signal to cease the flow of the LED current through the LED load in response to one of the output signal or the feedback signal.

20. The method of claim 19, further comprising:

blowing open a fusistor in response to the LED load operating as one of an open circuit or a short circuit; and ceasing the flow of the LED current through the LED load in response to the fusistor being blow open.

* * * * *